US008706014B2

(12) United States Patent
Matsumoto

(10) Patent No.: US 8,706,014 B2
(45) Date of Patent: Apr. 22, 2014

(54) FIXING UNIT AND IMAGE FORMING APPARATUS REDUCING OCCURRENCE OF WRINKLES ON RECORDING MEDIUM

(75) Inventor: Keigo Matsumoto, Tokyo (JP)

(73) Assignee: Oki Data Corporation, Tokyo (JP)

( * ) Notice: Subject to any disclaimer, the term of this patent is extended or adjusted under 35 U.S.C. 154(b) by 342 days.

(21) Appl. No.: 13/222,672

(22) Filed: Aug. 31, 2011

(65) Prior Publication Data

US 2012/0057910 A1 Mar. 8, 2012

(30) Foreign Application Priority Data

Sep. 6, 2010 (JP) ..... 2010-198962

(51) Int. Cl.
*G03G 15/20* (2006.01)

(52) U.S. Cl.
USPC ..... 399/329; 399/333

(58) Field of Classification Search
USPC ..... 399/328, 329, 333; 219/216
See application file for complete search history.

(56) References Cited

U.S. PATENT DOCUMENTS 4,682,878 A 7/1987 Takizawa et al.
7,333,762 B2 * 2/2008 Oishi et al. ..... 399/329
7,447,474 B2 * 11/2008 Fujino ..... 399/329
7,764,913 B2 * 7/2010 Tsunoda ..... 399/329
8,131,197 B2 * 3/2012 Hiraoka et al. ..... 399/329

FOREIGN PATENT DOCUMENTS

| | | | |
|---|---|---|---|
| EP | 1 569 047 | A2 | 8/2005 |
| JP | 2001-318544 | | 11/2001 |
| JP | 2004-191704 | A | 7/2004 |
| JP | 2005-275371 | A | 10/2005 |
| JP | 2007-271845 | | 10/2007 |
| JP | 2010-139642 | | 6/2010 |

* cited by examiner

*Primary Examiner* — William J Royer
(74) *Attorney, Agent, or Firm* — Rabin & Berdo, P.C.

(57) ABSTRACT

An image forming apparatus includes an image forming unit that forms a developer image on a recording medium using a developer, and a fixing unit that fixes the developer image to the recording medium. The fixing unit includes a heating member that heats the recording medium on which the developer image is formed, a plurality of pressure members that press the recording medium against the heating member, and a fixing belt stretched around the plurality of pressure members and nipped between the heating member and the plurality of pressure members so as to form a plurality of nip portions. Each of the plurality of pressure members has a shape in which a center portion protrudes more outward than both end portions.

9 Claims, 10 Drawing Sheets

FIXING UNIT AND IMAGE FORMING APPARATUS REDUCING OCCURRENCE OF WRINKLES ON RECORDING MEDIUM

BACKGROUND OF THE INVENTION

The present invention relates to an image forming apparatus using electrophotography such as a printer, a copier or a facsimile machine, and particularly relates to a fixing unit of the image forming apparatus.

A general image forming apparatus such as a printer, a copier, or a facsimile machine that forms a monochrome or color image includes an image forming unit that forms a developer image (i.e., a toner image), and a fixing unit that fixes the developer image to a recording medium by application of heat and pressure.

Recently, there is an increasing demand for a color image forming apparatus. In the color image forming apparatus, developer images of a plurality of colors are printed on the recording medium in an overlapping manner. Therefore, in order to fix the developer images to the recording medium, the fixing unit necessarily applies a large amount of heat and high pressure to the developer image. For this purpose, a conventional fixing unit has a large nip portion formed by a heating member and a pressure member in order to apply heat and pressure to the developer image for a long time period.

For example, the conventional fixing unit includes a fixing roller (as a heating member), a pressure roller and a pressure pad which are pressed against the fixing roller, and a fixing belt wound around the pressure roller and the pressure pad. The fixing belt contacts the fixing roller at two positions, i.e., two nip portions. The fixing unit of this type (i.e., a belt-nip type) is configured to apply heat and pressure to the developer image at two nip portions (i.e., for a long time period) so as to fix the color image to the recording medium. Such a conventional fixing unit is disclosed in, for example, Japanese Laid-open Patent Publication No. 2005-275371.

However, in the conventional fixing unit, wrinkles may be formed on the recording medium when the developer image is fixed to the recording medium.

SUMMARY OF THE INVENTION

In an aspect of the present invention, it is intended to provide an image forming apparatus and a fixing unit capable of preventing occurrence of wrinkles.

According to an aspect of the present invention, there is provided an image forming apparatus including an image forming unit that forms a developer image on a recording medium using a developer, and a fixing unit that fixes the developer image to the recording medium. The fixing unit includes a heating member that heats the recording medium on which the developer image is formed, a plurality of pressure members that press the recording medium against the heating member, and a fixing belt wound around the plurality of pressure members and nipped between the heating member and the plurality of pressure members so as to form a plurality of nip portions. Each of the plurality of pressure members has a shape in which a center portion protrudes more outward than both end portions.

With such a configuration, occurrence of wrinkles on the recording medium at the fixing unit can be prevented.

According to another aspect of the present invention, there is provided a fixing unit including a heating member that heats the recording medium on which the developer image is formed, a plurality of pressure members that press the recording medium against the heating member, and a fixing belt wound around the plurality of pressure members and nipped between the heating member and the plurality of pressure members so as to form a plurality of nip portions. Each of the plurality of pressure members has a shape in which a center portion protrudes more outward than both end portions.

Further scope of applicability of the present invention will become apparent from the detailed description given hereinafter. However, it should be understood that the detailed description and specific embodiments, while indicating preferred embodiments of the invention, are given by way of illustration only, since various changes and modifications within the spirit and scope of the invention will become apparent to those skilled in the art from this detailed description.

DETAILED DESCRIPTION OF THE PREFERRED EMBODIMENT

Hereinafter, embodiments of the present invention will be described with reference to the drawings.

First Embodiment

<Configuration>

Figure 1:
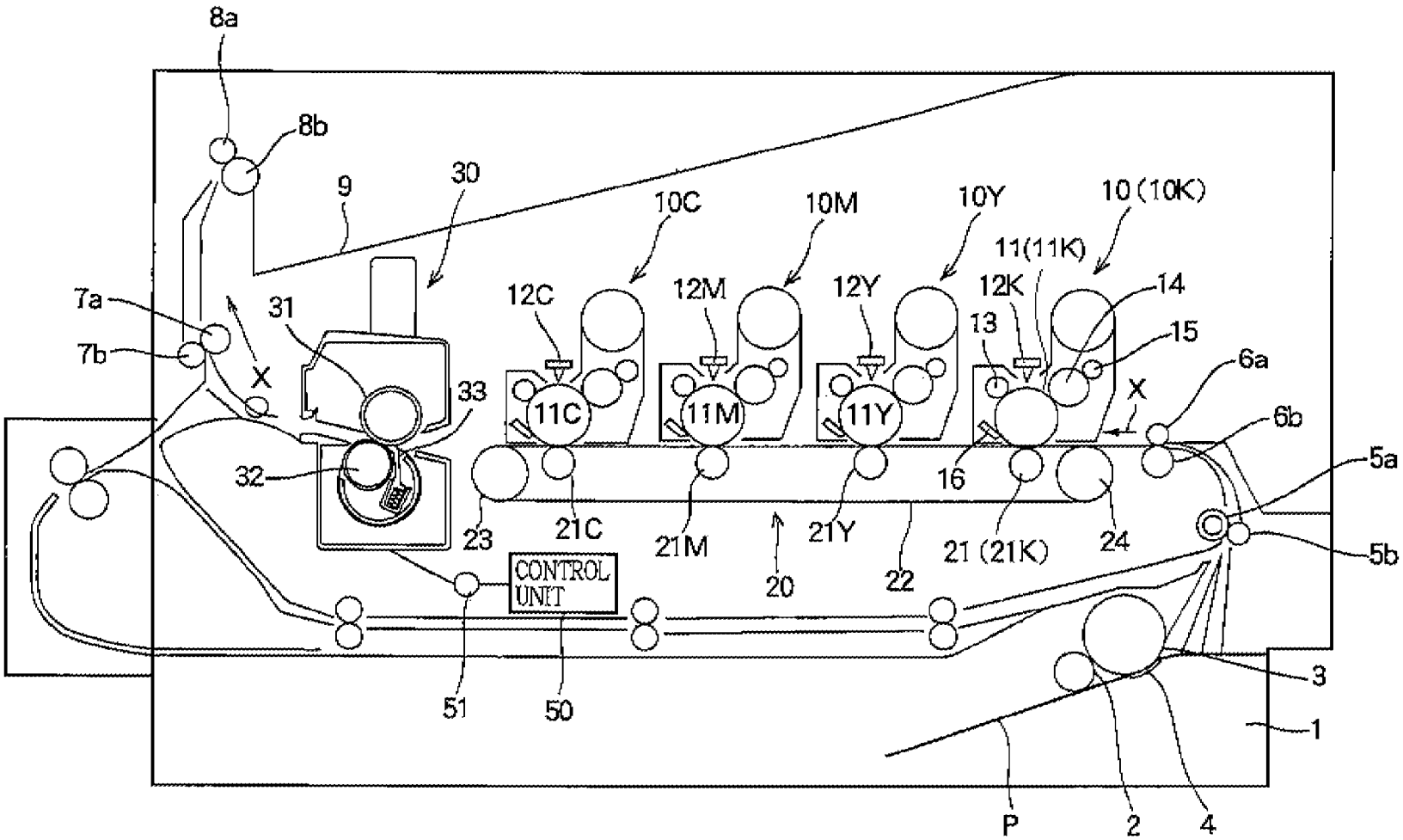
FIG. 1 is a schematic sectional view showing a configuration of an image forming apparatus according to the first embodiment of the present invention.

FIG. 1 is a schematic sectional view showing a configuration of an image forming apparatus according to the first embodiment of the present invention.

The image forming apparatus is configured as, for example, an electrophotographic page printer that forms an image on a sheet P as a recording medium.

The image forming apparatus includes a sheet tray 1 that stores a stack of the sheets P. The sheet tray 1 is detachably mounted to a lower part of the image forming apparatus, and defines an upstream end of a sheet conveying path (i.e., a medium conveying path). A pickup roller 2 is provided on a feeding side (i.e., an upper-right side in FIG. 1) of the sheet tray 1. The pickup roller 2 is pressed against a topmost sheet P of the stack stored in the sheet tray 1 (and lifted to a predetermined height), and feeds the sheet P out of the sheet tray 1. A feed roller 3 and a separation piece 4 are provided on a downstream side of the pickup roller 2 along the sheet conveying path. The feed roller 3 and the separation piece 4 separately feed the sheet P along the sheet conveying path.

A pair of conveying rollers 5*a* and 5*b* and another pair of conveying rollers 6*a* and 6*b* are provided on the downstream side of the feed roller 3 along the sheet conveying path. The conveying rollers 5*a*, 5*b*, 6*a* and 6*b* convey the sheet P to image forming units 10K, 10Y, 10M and 10C in a sheet conveying direction X (i.e., a medium conveying direction) along the sheet conveying path.

The image forming units 10K, 10Y, 10M and 10C are configured to form toner images (i.e., developer images) of Black (K), Yellow (Y), Magenta (M) and Cyan (C). The image forming units 10K, 10Y, 10M and 10C respectively include photosensitive drums 11K, 11Y, 11M and 11C as image bearing bodies. The photosensitive drums 11K, 11Y, 11M and 11C are exposed with light emitted by LED heads 12K, 12Y, 12M and 12C (as exposure units) so that latent images are formed on the photosensitive drums 11K, 11Y, 11M and 11C. The image forming units 10K, 10Y, 10M and 10C are detachably mounted to a main body of the image forming apparatus.

Here, the image forming units 10K, 10Y, 10M and 10C are collectively referred to by numeral 10, and the photosensitive drums 11K, 11Y, 11M and 11C are collectively referred to by numeral 11.

Each image forming unit 10 includes a charging roller 13 (as a charging member) that uniformly charges a surface of the photosensitive drum 11, a developing roller 14 (as a developer bearing body) that develops the latent image on the surface of the photosensitive drum 11, a supplying roller 15 (as a supplying member) that supplies the toner to the developing roller 14, and a cleaning member 16 that removes a residual toner from the photosensitive drum 11.

A transfer unit 20 is provided below the image forming units 10K, 10Y, 10M and 10C. The transfer unit 20 includes transfer rollers 21K, 21Y, 21M and 21C (collectively referred to by numeral 21) that transfer the toner images from the photosensitive drums 11K, 11Y, 11M and 11C to the sheet P by means of Coulomb force, a conveying belt 22 that conveys the sheet P, and a driving roller 23 and a driven roller 24 around which the conveying belt 22 is wound. The driving roller 23 and the driven roller 24 are driven to rotate to move the conveying belt 22.

A fixing unit 30 is provided on the downstream side of the transfer unit 20 along the sheet conveying path. The fixing unit 30 is configured to fix the toner image (i.e., developer image) to the sheet P by applying heat and pressure. The fixing unit 30 is detachably mounted to the main body of the image forming apparatus. The fixing unit 30 is linked with a fixing unit driving motor 51. The fixing unit driving motor 51 is controlled by a control unit 50.

A pair of ejection rollers 7*a* and 7*b* and another pair of ejection rollers 8*a* and 8*b* are provided on the downstream side of the fixing unit 30 along the sheet conveying path. The ejection rollers 7*a*, 7*b*, 8*a* and 8*b* eject the sheet P (to which the toner image is fixed by the fixing unit 30) to the outside of the image forming apparatus. The ejected sheet P is placed on a stacker portion 9.

Figure 2:
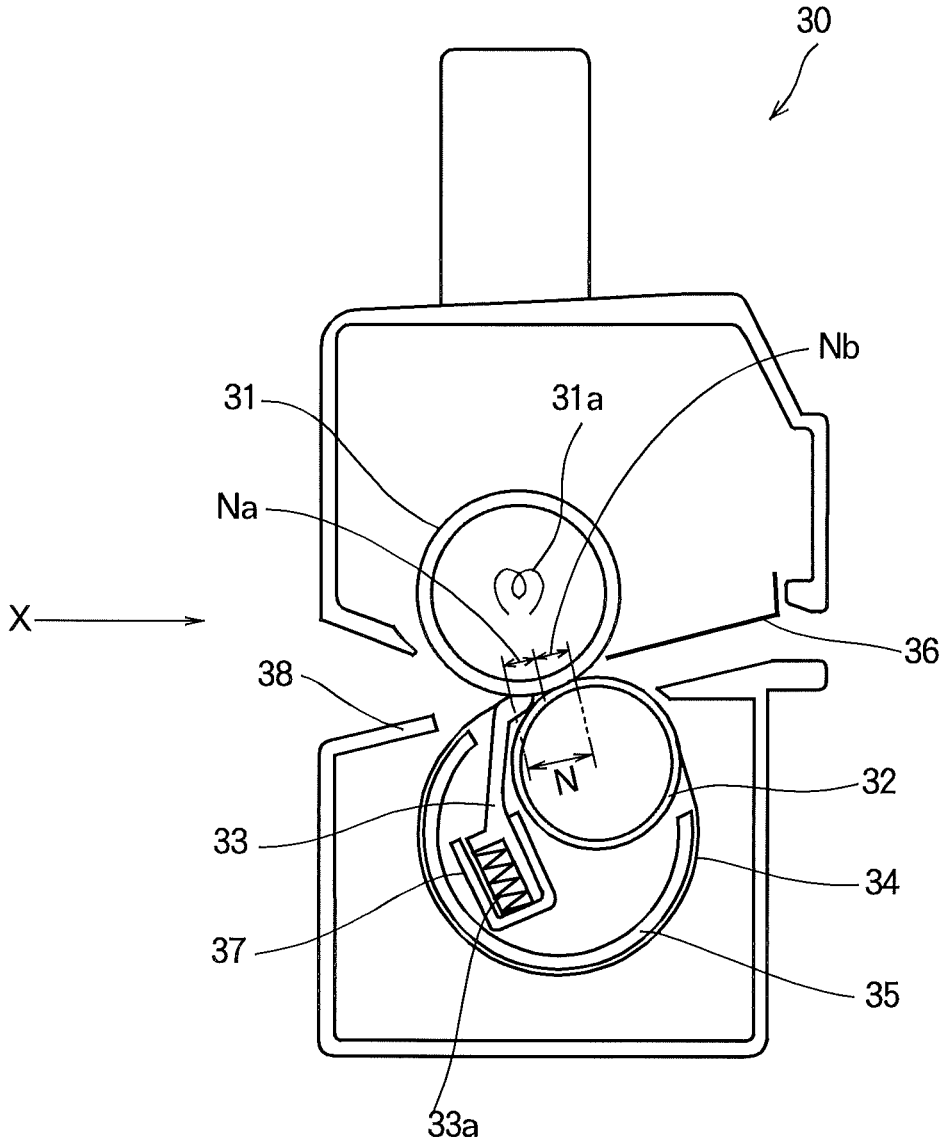
FIG. 2 is a cross sectional view showing a fixing unit according to the first embodiment of the present invention.
Figure 3:
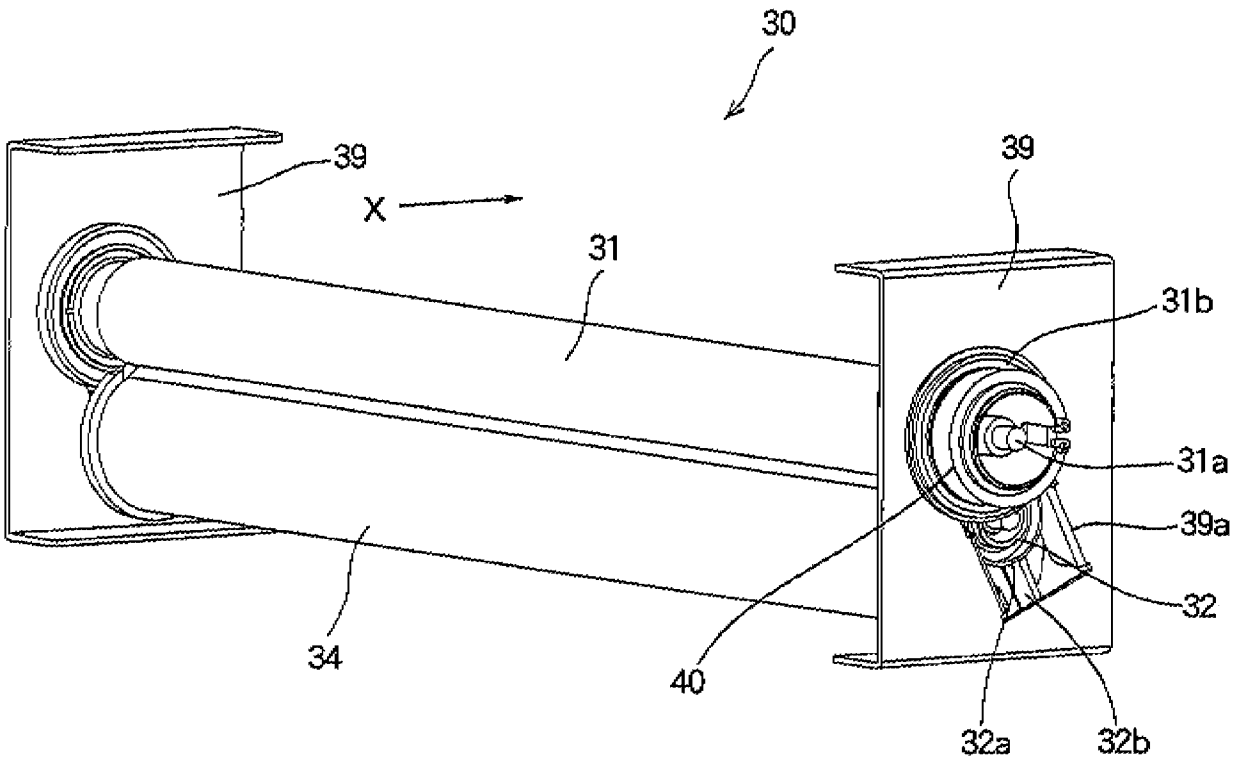
FIG. 3 is a perspective view showing the fixing unit according to the first embodiment of the present invention.

FIG. 2 is a cross sectional view showing the fixing unit 30 according to the first embodiment. FIG. 3 is a perspective view showing the fixing unit 30 according to the first embodiment.

The fixing unit 30 includes a fixing roller 31 (as a heating member) that heats the sheet P on which the toner image is transferred. The fixing unit 30 further includes a pressure roller 32 (as a first pressure member) and a pressure pad 33 (as a second pressure member) that press the sheet P against the fixing roller 31. The fixing unit 30 further includes a fixing belt 34 wound around the pressure roller 32 and the pressure pad 33. A fixing belt guide 35 (as a guide member) having an arcuate cross section is provided so as to guide the fixing belt 34 along a substantially circular path. The fixing belt 34 rotates along the pressure roller 32, the pressure pad 33 and the fixing belt guide 35 while contacting the fixing roller 31.

The pressure roller 32 and the pressure pad 33 are disposed inside the fixing belt 34, and press the fixing belt 34 against the fixing roller 31. The pressure pad 33 is provided on an upstream side of the pressure roller 32 in a rotating direction of the fixing belt 34 (i.e., the sheet conveying direction X). The pressure pad 33 is pressed against the fixing roller 31 via the fixing belt 34 by a biasing force of a spring 33*a* as a biasing member, so as to form a nip portion Na. The pressure roller 32 is pressed against the fixing roller 31 via the fixing belt 34 by a biasing force of springs 32*b* (FIG. 3) as biasing members, so as to form a nip portion Nb.

The fixing roller 31 includes a core (i.e., a hollow pipe) made of metal such as iron or aluminum, a heat-resisting resilient layer (as a resilient body) of silicone rubber covering the core, and a release layer (i.e., a coating layer) of fluorine resin covering the resilient layer. Bearings 31*b* are provided on both ends of the fixing roller 31, and the bearings 31*b* are supported by supporting members 39. The fixing roller 31 is rotatably supported by the bearings 31*b*. A driving gear 40 is fixed to an end of the fixing roller 31 using a key-and-groove engagement and a retaining ring. The driving gear 40 is linked with the fixing unit driving motor 51.

A halogen lamp 31*a* is provided in the fixing roller 31. The halogen lamp 31*a* is mounted to the supporting members 39 by means of a holder (not shown). The halogen lamp 31*a* is connected to a power source (not shown) of the image forming apparatus, and a temperature of the halogen lamp 31*a* is controlled by the control unit 50. A thermistor (not shown) is provided in contact with the fixing roller 31 for detecting a temperature of the fixing roller 31, and is connected to the control unit 50. The control unit 50 controls a power supply to the halogen lamp 31*a* based on the temperature detected by the thermistor.

The pressure roller 32 is, for example, a hard roller formed of metal such as iron, and has hardness harder than the fixing roller 31. Bearings 32*a* are fixed to both ends of the pressure roller 32. The pressure roller 32 is rotatably supported by the bearings 32*a*. The bearings 32*a* are mounted to pressure roller guides 39*a* so as to be movable along the pressure roller guides 39*a*. An end of each spring 32*b* is fixed to the bearing 32*a*, and another end of each spring 32*b* is fixed to the supporting member 39. With the biasing force of the springs 32*b*, the pressure roller 32 is pressed against the fixing roller 31 along the pressure roller guides 39*a*.

As shown in FIG. 2, the pressure pad 33 is supported by a pressure pad guide 37 so as to be movable along the pressure pad guide 37. The pressure pad 33 is biased by the spring 33*a* one end of which is fixed to the pressure pad guide 37, and the pressure pad 33 is pressed against the fixing roller 31 via the fixing belt 34.

The fixing belt 34 is an endless belt composed of, for example, a base layer of polyimide and a release layer formed on the base layer. The fixing belt 34 is wound around the fixing belt guide 35 fixed to the supporting members 39, the pressure roller 32 and the pressure pad 33. The fixing belt 34 is nipped by the fixing roller 31 and the pressure pad 33 to form the nip portion Na, and is nipped by the fixing roller 31 and the pressure roller 32 to form the nip portion Nb. The nip portion Na and the nip portion Nb form a nip portion N.

Since the fixing unit 30 has two nip portions Na and Nb, a large amount of heat can be applied to the sheet P in a fixing process as compared with a fixing unit having only one nip portion. Therefore, it becomes possible to lower the temperature of the fixing roller 31, or to increase a printing speed.

Further, a biasing force (i.e., a pressure) with which the pressure roller 32 is pressed against the fixing roller 31 at the nip portion Nb is larger than a biasing force (i.e., a pressure) with which the pressure pad 33 is pressed against the fixing roller 31 at the nip portion Na. With such an arrangement, the pressure applied to the toner (on the sheet P) is higher at an inlet portion of the nip portion N than at an outlet portion of the nip portion N. Therefore, the toner can be efficiently and effectively fixed to the sheet P.

To be more specific, the toner has characteristics such that the higher the temperature is, the more the toner melts. When the sheet P passes the nip portion Na, the toner is not sufficiently heated, and therefore does not sufficiently melt. When the sheet P passes the nip portion Nb, the toner is sufficiently heated. Therefore, by applying a relatively high pressure to the sheet P (with the toner) at the nip portion Nb, the toner sufficiently melts and is effectively fixed to the sheet P.

The fixing unit 30 has a sheet guide 38 fixed to the supporting members 39. The sheet guide 38 functions to guide the sheet P (conveyed from the transfer unit 20) to the nip portion N. Further, the fixing unit 30 has a separation plate 36 reaching the vicinity of the fixing, roller 31. The separation plate 36 functions to separate the sheet P (sticking to the surface of the fixing roller 31) from the fixing roller 31.

Figure 4A:
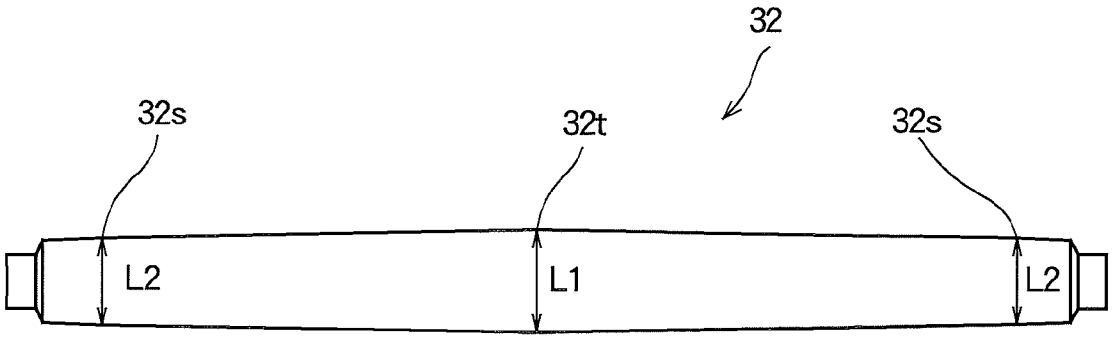
FIGS. 4A and 4B are a front view and a perspective view showing a fixing roller according to the first embodiment of the present invention.
Figure 4B:
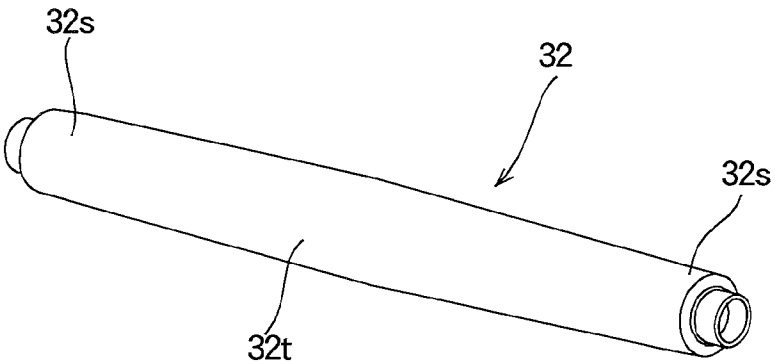

FIGS. 4A and 4B are a front view and a perspective view showing the pressure roller 32 of the first embodiment. The pressure roller 32 has a shape (i.e., a crown shape) in which a center portion 32*t* protrudes more outward than both end portions 32*s*. To be more specific, a diameter of the pressure roller 32 is the largest at the center portion 32*t* and decreases toward both end portions 32*s*. In this embodiment, a difference (i.e., a crown amount) between a radius r1 (=L1/2) of the center portion 32*t* and a radius r2 (=L2/2) of the end portion 32*s* is 0.125 mm.

Figure 5A:
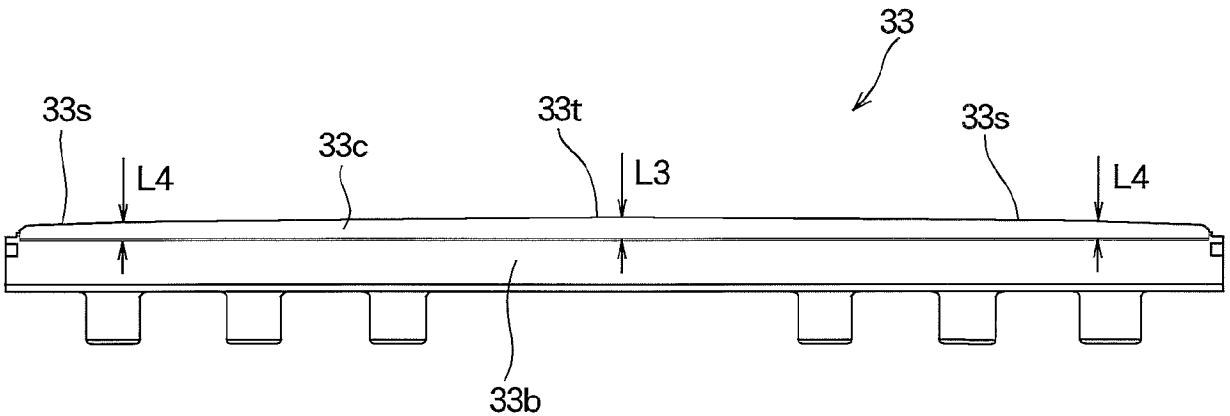
FIGS. 5A and 5B are a front view and a perspective view showing a pressure pad according to the first embodiment of the present invention.
Figure 5B:
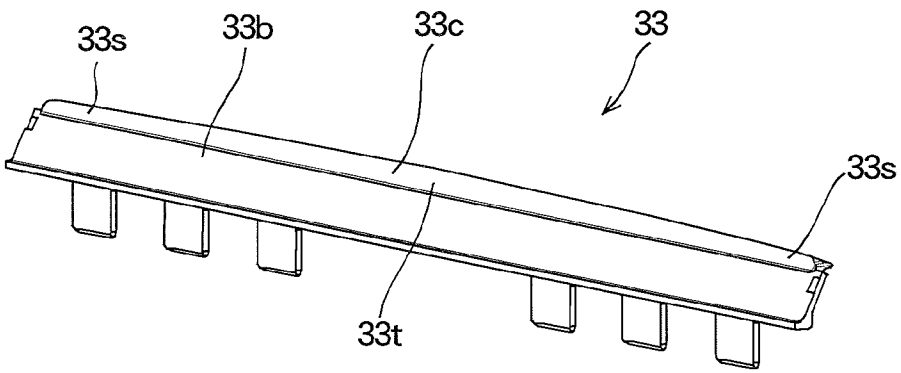

FIGS. 5A and 5B are a front view and a perspective view showing the pressure pad 33 of the first embodiment. The pressure pad 33 includes a pressure pad main body 33*b* made of aluminum, and a tip portion 33*c* made of resilient material (in this example, rubber). The tip portion 33*c* is treated with a fluorine coating, and slidably contacts an inner circumferential surface of the fixing belt 34 wound around the pressure pad 33. Further, the tip portion 33*c* of the pressure pad 33 has higher hardness than the fixing roller 31.

The tip portion 33*c* has a shape (i.e. a crown shape) such that a center portion 33*t* protrudes more outward than both end portions 33*s*. A height L3 of the center portion 33*t* is higher than a height L4 of the both end portions 33*s*. That is, a value obtained by subtracting the height L4 from the height L3 is greater than zero. In this embodiment, a difference (i.e., a crown amount) between the height L3 of the center portion 33*t* and the height L4 of the end portion 33*s* is 0.15 mm. Through experiments using the fixing unit 30 of this embodiment, it has been found out that wrinkles may occur when the crown amount is 0.07 mm or less.

<Operation of Image Forming Apparatus>

An operation of the image forming apparatus will be described with reference to FIG. 1.

The sheet P stored in the sheet tray 1 is picked up by the pickup roller 2, and is fed into the sheet conveying path by the feed roller 3. Further, the sheet P is conveyed by the conveying rollers 5*a* and 5*b* and the conveying rollers 6*a* and 6*b* along the sheet conveying path to reach the image forming unit 10K. The control unit 50 receives printing job from a host device (not shown), and sends the printing job to the LED heads 12K, 12Y, 12M and 12C. The LED heads 12K, 12Y, 12M and 12C emit lights so as to expose the surfaces of the photosensitive drums 11K, 11Y, 11M and 11C, and latent images are formed on the photosensitive drums 11K, 11Y, 11M and 11C. The sheet P is conveyed by the conveying belt 22 and proceeds through the image forming units 10K, 10Y, 10M and 10C.

In the respective image forming units 10K, 10Y, 10M and 10C, the developing rollers 14 rotate contacting the surface of the photosensitive drums 11K, 11Y, 11M and 11C, and develop the latent images using the toner so as to form toner images. The toner images on the surfaces of the photosensitive drums 11K, 11Y, 11M and 11C are transferred to the sheet P by means of electric fields between the photosensitive drums 11K, 11Y, 11M and 11C and the transfer rollers 21K, 21Y, 21M and 21C of the transfer unit 20. The sheet P is conveyed to the fixing unit 30 by the conveying belt 22. In the fixing unit 30, the toner is fixed to the sheet P. Then, the sheet P is ejected by the ejection rollers 7*a* and 7*b* and the ejection rollers 8*a* and 8*b* to the outside of the image forming apparatus, and is placed on the stacker portion 9.

<Operation of Fixing Unit>

An operation of the fixing unit 30 will be described with reference to FIGS. 1, 2 and 3.

When the fixing unit driving motor 51 is driven to rotate under control of the control unit 50, the driving gear 40 rotates, and the fixing roller 31 rotates along the sheet conveying direction X. When the fixing roller 31 rotates, the pressure roller 32 and the fixing belt 34 (both of which are pressed against the fixing roller 31) rotate following the rotation of the fixing roller 31.

The halogen lamp 31*a* in the fixing roller 31 is supplied with electric power from the power source (not shown) controlled by the control unit 50, and generates heat. When the halogen lamp 31*a* generates heat, the fixing roller 31 is heated. The heat of the fixing roller 31 is transferred to the fixing belt 34, the pressure roller 32 and the pressure pad 33 which are pressed against the fixing roller 31. Therefore, the fixing belt 34, the pressure roller 32 and the pressure pad 33 are also heated. The temperature of the fixing roller 31 is detected by the thermistor, and the control unit 50 performs ON/OFF control of the halogen lamp 31*a* to maintain the temperature of the fixing roller 31 within a suitable range.

After the toner image is transferred to the sheet P by the transfer unit 20, the sheet P is conveyed to the fixing unit 30 by the conveying belt 22. The sheet P moves along the sheet guide 38 and reaches the nip portion N. The sheet P is nipped and conveyed by the fixing roller 31 and the fixing belt 34. First, at the nip portion Na, the toner (transferred to the sheet P by the transfer unit 20) melts and is pressed against the sheet P. Then, at the nip portion Nb, the toner is further heated, and melting of the toner further proceeds. The toner is applied with higher pressure at the nip portion Nb than at the nip portion Na, and the toner is effectively fixed to the sheet P.

After the sheet P passes the nip portion N (Na, Nb), the sheet P is separated from the surface of the fixing roller 31 by the separation plate 36, and is guided by the separation plate 36 to reach the ejection rollers 7*a* and 7*b*. Then, the sheet P is ejected by the ejection rollers 7*a*, 7*b*, 8*a* and 8*b* to the outside of the image forming apparatus, and is placed on the stacker portion 9.

Figure 6A:
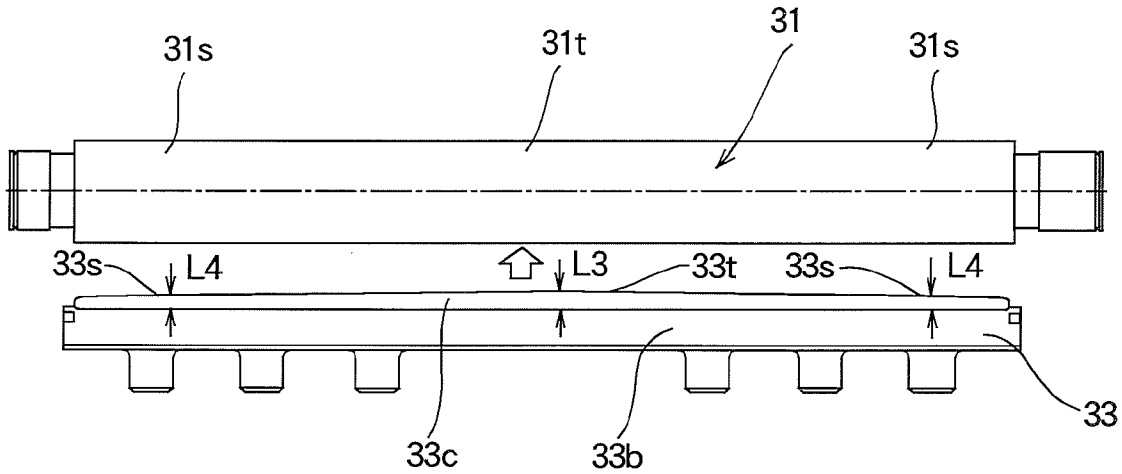
FIG. 6A shows the fixing roller and the pressure pad according to the first embodiment of the present invention in a state where the fixing roller and the pressure pad are apart from each other.
Figure 6B:
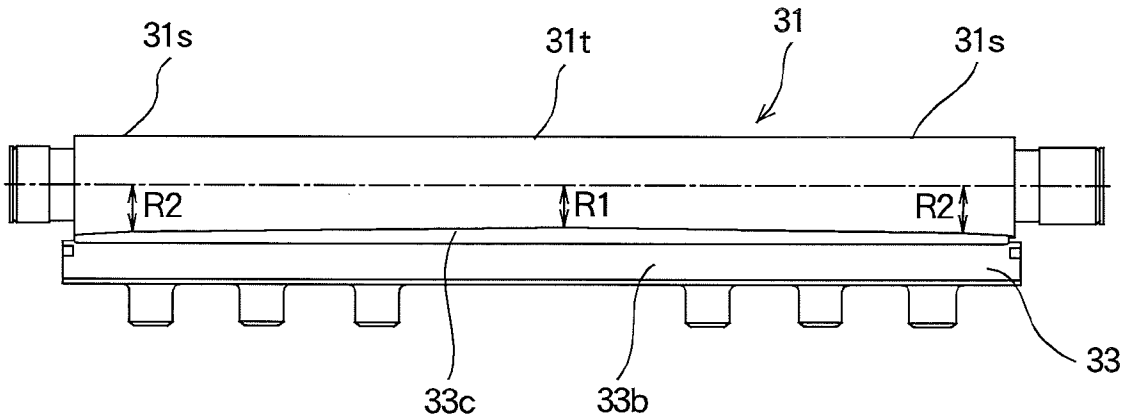
FIG. 6B shows the fixing roller and the pressure pad according to the first embodiment of the present invention in a state where the pressure pad is pressed against the fixing roller.

FIGS. 6A and 6B are schematic views showing an operation of the fixing roller 31 and the pressure pad 33 according to the first embodiment.

FIG. 6A shows the fixing roller 31 and the pressure pad 33 in a state where the fixing roller 31 and the pressure pad 33 are apart from each other. As described above, the tip portion 33*c* of the pressure pad 33 has the crown shape in which the height L3 of the center portion 33*t* is higher than the height L4 of both end portions 33*s*. The fixing roller 31 has a straight shape in which a diameter of a center portion 31*t* is the same as a diameter of both end portions 31*s*.

FIG. 6B shows the fixing roller 31 and the pressure pad 33 in a state where the pressure pad 33 is pressed against the fixing roller 31. In FIG. 6B, the fixing belt 34 is omitted. The fixing roller 31 is made of silicone rubber, and the pressure pad 33 (the tip portion 33*c*) has higher hardness than the fixing roller 31. Therefore, the fixing roller 31 is resiliently deformed when the pressure pad 33 is pressed against the fixing roller 31. As a result, the fixing roller 31 is deformed in a reverse-crown shape so as to tightly contact the pressure pad 33. In this state, the fixing roller 31 is so shaped that a rotation radius R2 of both end portions 31*s* is larger than a rotation radius R1 of the center portion 31*t*.

Figure 7:
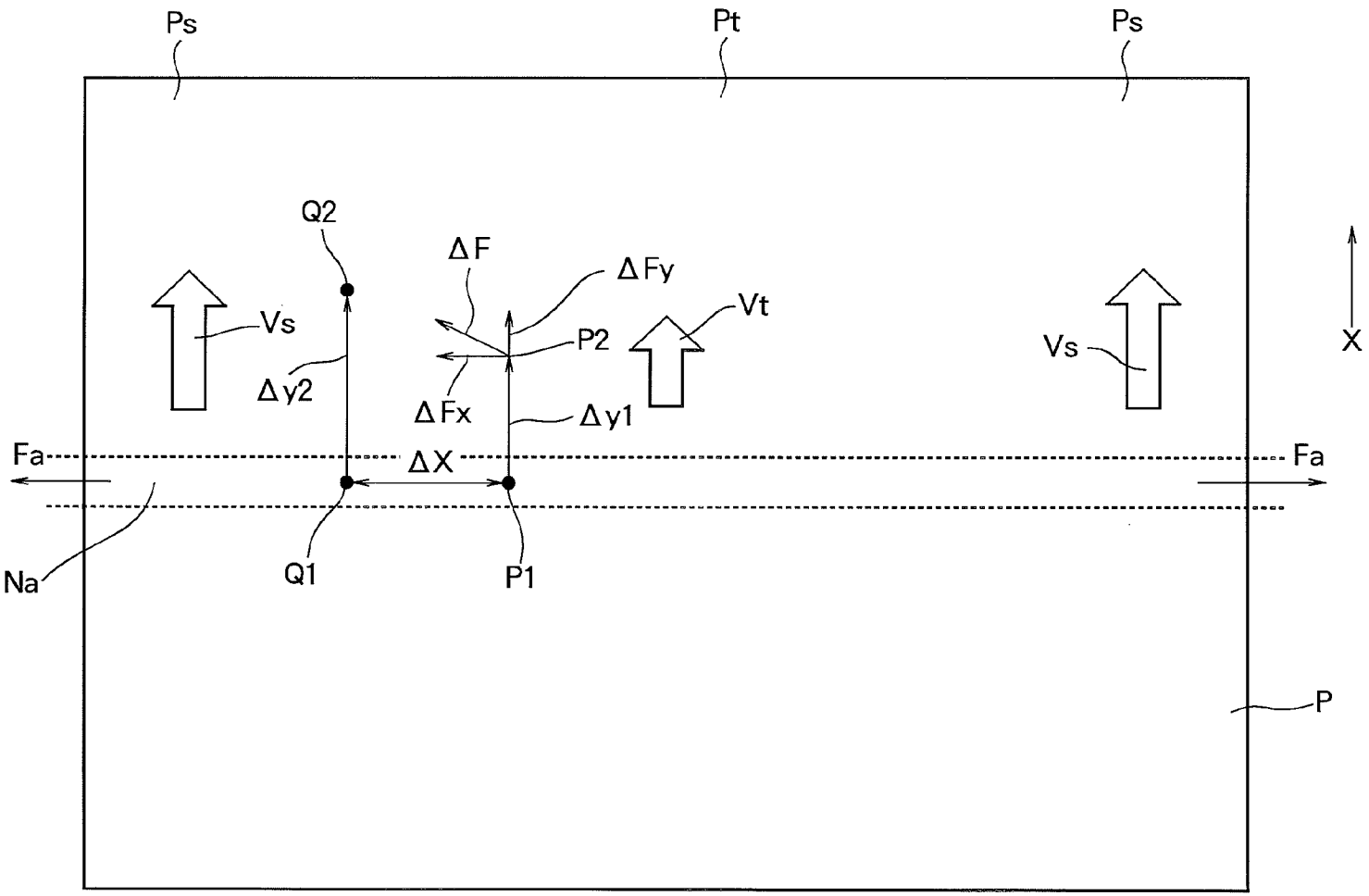
FIG. 7 is a schematic view showing a distribution of a sheet conveying speed in the vicinity of a nip portion according to the first embodiment of the present invention.

FIG. 7 is a schematic view showing a distribution of a conveying speed of the sheet P (i.e., a sheet conveying speed or a medium conveying speed) in the vicinity of the nip portion N according to the first embodiment.

As described above, the fixing roller 31 is deformed so that the rotation radius R2 of the end portion 31*s* is larger than the rotation radius R1 of the center portion 31*t*. Since the nip portion Na is formed by the pressure pad 33 and the fixing roller 31 via the fixing belt 34, a difference in the sheet conveying speed (by the rotation of the fixing roller 31) may occur between a center portion Pt and both end portions Ps of the sheet P.

As shown in FIG. 7, when the sheet P passes the nip portion Na, a sheet conveying speed Vs at both end portions Ps is faster than a sheet conveying speed Vt at the center portion Pt. Therefore, the sheet P is conveyed while a force Fa acts on both end portions Ps of the sheet P to pull the sheet P outward.

A reason of generation of the force Fa pulling the sheet P outward can be understood as follows.

Points P1 and Q1 are defined in the nip portion Na. The points P1 and Q1 are apart from each other by a small distance ΔX in a direction perpendicular to the sheet conveying direction X (i.e., in a width direction of the sheet P). The point P1 is closer to the center portion Pt of the sheet P than the point Q1 is.

In a small time interval Δt, a portion of the sheet P located at the point P1 moves to a point P2 which is ahead of the point P1 by a distance Δy1. A portion of the sheet P located at the point Q1 moves to a point Q2 which is ahead of the point Q1 by a distance Δy2. Since the sheet conveying speed is faster at both end portions Ps than at the center portion Pt, the following relationship is obtained:

$$\Delta y2 > \Delta y1.$$

In this state, since the point Q2 is ahead of the point P2, a portion of the sheet P located at the point P2 is pulled by a portion of the sheet P located at the point Q2 with a pulling force ΔF. The pulling force ΔF can be divided into a force ΔFy in the sheet conveying direction X, and a force ΔFx acting outward (i.e., toward the end portions Ps). At each of the respective points on the sheet P, the force ΔFx is generated toward the end portions Ps. It is understood that the force Fa pulling the sheet P outward is obtained by integrating the force ΔFx from the center portion Pt to both end portions Ps in the width direction of the sheet P.

Figure 8A:
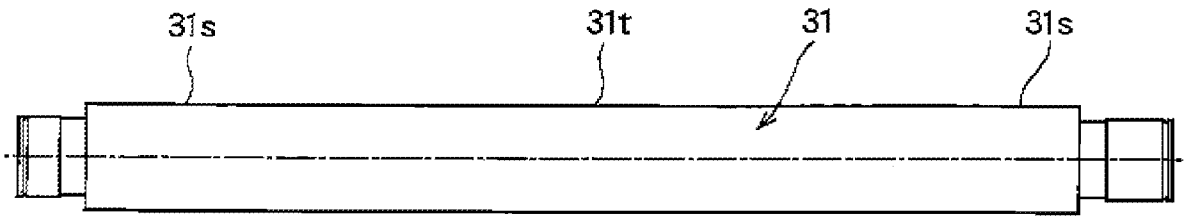
FIGS. 8A and 8B respectively show the fixing roller and a pressure roller according to the first embodiment of the present invention in a state where the fixing roller and the pressure roller are apart from each other.
Figure 8B:
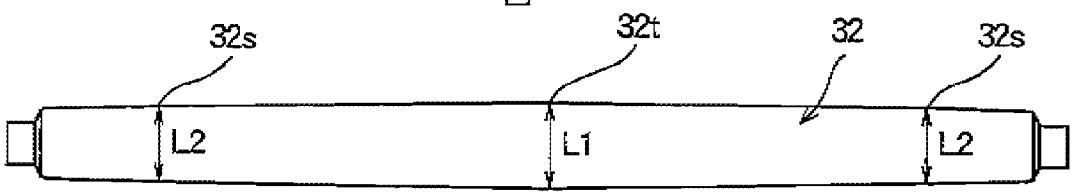
Figure 8C:
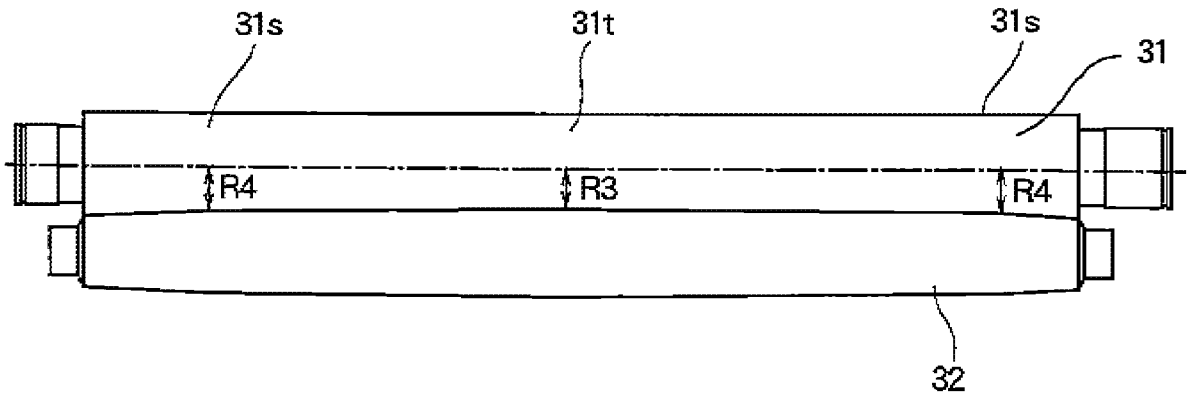
FIG. 8C shows the fixing roller and the pressure roller according to the first embodiment of the present invention in a state where the pressure roller is pressed against the fixing roller.

FIGS. 8A, 8B and 8C show the fixing roller 31 and the pressure roller 32.

FIGS. 8A and 8B respectively show the fixing roller 31 and the pressure roller 32 in a state where the fixing roller 31 and the pressure roller 32 are apart from each other. As described above, the pressure roller 32 has the crown shape in which the diameter L1 of the center portion 32*t* is larger than the diameter L2 of both end portions 32*s*. In contrast, the fixing roller 31 has the straight shape in which the diameter of the center portion 31*t* is the same as the diameter of both end portions 31*s*.

FIG. 8C shows the fixing roller 31 and the pressure roller 32 in a state where the pressure roller 32 is pressed against the fixing roller 31. In FIG. 8C, the fixing belt 34 is omitted. As described above, the fixing roller 31 has a roller part made of silicone rubber, and the pressure roller 32 is a hard roller having higher hardness than the fixing roller 31. Therefore, the fixing roller 31 is resiliently deformed when the pressure roller 32 is pressed against the fixing roller 31. As a result, the fixing roller 31 is deformed in the reverse-crown shape, and tightly contacts the pressure roller 32. In this state, the fixing roller 31 is so shaped that a rotation radius R4 of both end portions 31*s* is larger than a rotation radius R3 of the center portion 31*t*.

Since the nip portion Nb is formed by the pressure roller 32 and the fixing roller 31 via the fixing belt 34, a difference in the sheet conveying speed may occur between the center portion Pt and both end portion Ps of the sheet P. Therefore, when the sheet P passes the nip portion Nb, the sheet P is subject to a force to pull the sheet P outward in a similar manner as shown in FIG. 7. Therefore, the sheet P is conveyed while the force acts on both end portions Ps of the sheet P to pull the sheet P outward. Thus, generation of wrinkles on the sheet P is prevented.

<Advantages>

According to the image forming apparatus of the first embodiment, the pressure roller 32 and the pressure pad 33 have the crown shape (i.e., in which the center portion protrudes more outward than both end portions). With such a configuration, the sheet P passes the nip portion N while the sheet P is subject to the force pulling the sheet P outward. Therefore, generation of wrinkles on the sheet P can be prevented.

Second Embodiment

<Configuration>

Figure 9A:
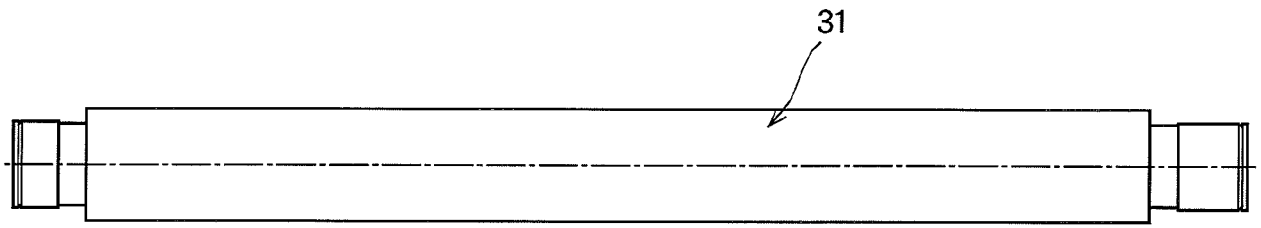
FIGS. 9A, 9B and 9C show configurations of a fixing roller, a pressure roller and a pressure pad according to the second embodiment of the present invention.
Figure 9B:
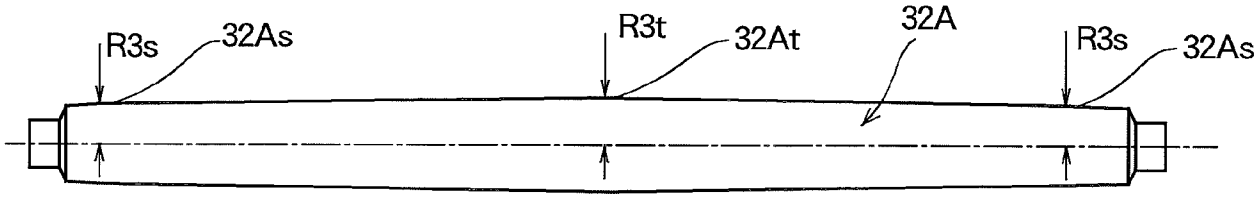
Figure 9C:
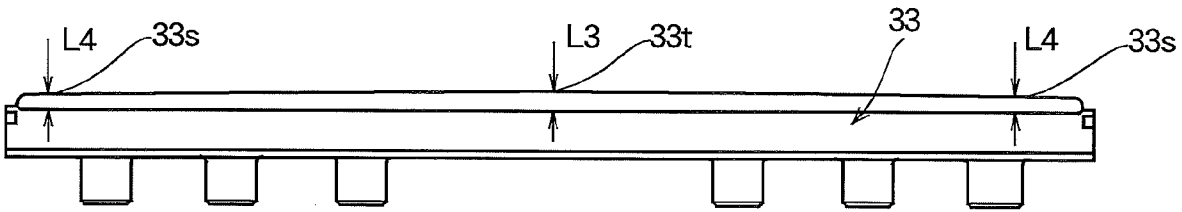

FIGS. 9A, 9B and 9C are front views of a fixing roller 31, a pressure roller 32A and a pressure pad 33 of the second embodiment of the present invention.

The image forming apparatus of the second embodiment is different from that of the first embodiment in the structure of the fixing unit 30. More specifically, the fixing unit 30 is different from that of the first embodiment in the crown amount of the pressure roller 32A. Although the crown amount of the pressure roller 32 of the first embodiment is 0.125 mm, the crown amount of the pressure roller 32A of the second embodiment is 0.2 mm. In this regard, the crown amount of the pressure pad 33 (FIG. 9C) of the second embodiment is 0.15 mm, which is the same as that of the first embodiment.

In FIG. 9B, the crown amount of the pressure roller 32A is obtained by subtracting the radius R3*s* of each end portion 32As from the radius R3*t* of a center portion 32At. In the second embodiment, the crown amount (0.2 mm) of the pressure roller 32A is larger than the crown amount (0.125 mm) of the pressure pad 33. Other structures of the image forming apparatus of the second embodiment are the same as those of the image forming apparatus of the first embodiment.

<Operation>

An entire operation of the image forming apparatus of the second embodiment is the same as that of the first embodiment. Hereinafter, an operation of the fixing unit 30 of the second embodiment will be described.

Figure 10:
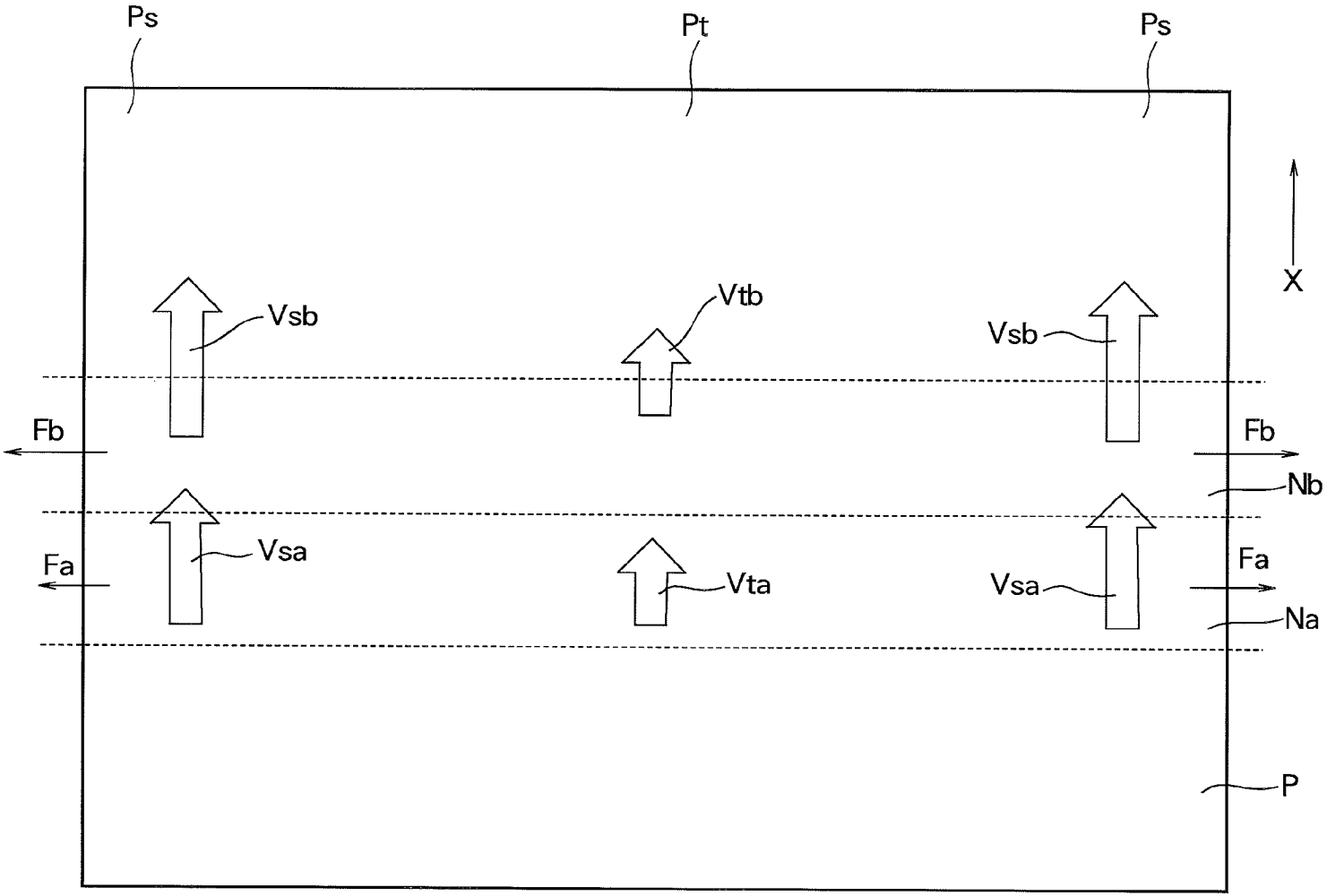
FIG. 10 is a schematic view showing a distribution of a sheet conveying speed in the vicinity of a nip portion according to the second embodiment of the present invention.

FIG. 10 is a schematic view showing a distribution of the sheet conveying speed in the vicinity of the nip portion N according to the second embodiment.

In the nip portion Na formed by the pressure pad 33 and the fixing roller 31 via the fixing belt 34, a difference in the sheet conveying speed may occur between a center portion Pt (Vta) and both end portions Ps (Vsa) of the sheet P, since the pressure pad 33 has the crown shape. Therefore, when the sheet P passes the nip portion Na, the sheet P is conveyed while the sheet P is subject to a force Fa pulling the sheet P outward as described in the first embodiment.

Further, in the nip portion Nb formed by the pressure roller 32 and the fixing roller 31 via the fixing belt 34, a difference in the sheet conveying speed may occur between the center portion Pt (Vtb) and both end portions Ps (Vsb) of the sheet P, since the pressure roller 32 has the crown shape. Therefore, when the sheet P passes the nip portion Nb, the sheet P is subject to a force Fb pulling the sheet P outward.

In this state, the crown amount of the pressure roller 32 is larger than the crown amount of the pressure pad 33 as described above, and therefore the force Fb pulling the sheet P outward by the pressure roller 32 is larger than the force Fa pulling the sheet P outward by the pressure pad 33 (i.e., Fb>Fa). Therefore, the force pulling the sheet P outward increases in a downstream direction along the sheet conveying direction X.

<Advantages>

The fixing unit 30 and the image forming apparatus of the second embodiment provide the following advantages in addition to the advantages of the first embodiment.

In the second embodiment, the force pulling the sheet P outward increases in the downstream direction along the sheet conveying direction X. Therefore, the sheet P is continuously pulled outward while the sheet P passes the nip portions Na and Nb. Thus, wrinkling of the sheet P can be further effectively prevented.

Modifications

The above described first and second embodiments can be modified or improved in many ways.

In the first and second embodiments, the page printer has been described as an example of the image forming apparatus. However, the present invention is also applicable to a facsimile machine, a copier, an MFP (Multifunction Peripheral) or the like.

In the first and second embodiments, the pressure pad 33 and the pressure roller 32 have the crown shapes, and the fixing roller 31 has the straight shape. However, it is also possible that the fixing roller 31' has a reverse-crown shape (i.e., in which both end portions protrude more outward than the center portion).

In the first and second embodiments, the fixing roller 31 has the halogen lamp 31*a* therein. However, it is also possible that the pressure roller 32 (32A) has a halogen lamp therein.

In the first and second embodiments, the pressure roller 32 (32A) and the pressure pad 33 are provided as a plurality of pressure members. However, it is also possible to provide a plurality of the pressure rollers 32 (32A) or a plurality of the pressure pads 33.

In the first and second embodiments, the fixing roller 31 has the halogen lamp 31*a* as a heating element. However, it is also possible to use an induction heating body.

While the preferred embodiments of the present invention have been illustrated in detail, it should be apparent that modifications and improvements may be made to the invention without departing from the spirit and scope of the invention as described in the following claims.

What is claimed is:

1. A fixing unit comprising:

a heating member that heats a recording medium bearing a developer image;

a first pressure member that presses said recording medium against said heating member, said first pressure member having a higher hardness than said heating member;

a second pressure member that presses said recording medium against said heating member, said second pressure member having a higher hardness than said heating member, and said second pressure member being disposed upstream of said first pressure member in a first direction in which said recording medium is fed; and a fixing belt stretched around said first pressure member and said second pressure member, said fixing belt being nipped between said heating member and said first pressure member and between said heating member and said second pressure member;

wherein said first pressure member has a shape in which a center portion in a second direction perpendicular to said first direction protrudes more outward than both end portions by a first protruding amount; and wherein said second pressure member has a shape in which a center portion in said second direction protrudes more outward than both end portions by a second protruding amount, said second protruding amount being different from said first protruding amount.

2. The fixing unit according to claim 1, wherein said first pressure member and said second pressure member apply forces to said recording medium, the forces pulling said recording medium outward in a widthwise direction of said recording medium.

3. The fixing unit according to claim 1, wherein said first protruding amount is larger than said second protruding amount.

4. The fixing unit according to claim 1, wherein said heating member is a fixing roller rotatably supported by a supporting member; and wherein said first pressure member includes a pressure roller pressed against said fixing roller, and said second pressure member includes a pressure pad pressed against said fixing roller.

5. The fixing unit according to claim 4, wherein said fixing roller has a resilient body.

6. The fixing unit according to claim 5, wherein said resilient body is made of silicone rubber.

7. The fixing unit according to claim 4, wherein said pressure pad includes a tip portion contacting said fixing belt, and said tip portion is coated with a fluorine coating.

8. The fixing unit according to claim 4, wherein said first protruding amount is larger than said second protruding amount.

9. An image forming apparatus comprising:

the fixing unit according to claim 1; and an image forming unit that forms said developer image on said recording medium.

* * * * *